US005863169A

United States Patent [19]

Inkeroinen

[11] Patent Number: 5,863,169

[45] Date of Patent: Jan. 26, 1999

[54] METHOD AND DEVICE FOR INSTALLING LIGHT-WEIGHT PANEL UNITS

[76] Inventor: Jukka Inkeroinen, Metsäkuja 4, FIN-21600 Parainen, Finland

[21] Appl. No.: 716,136

[22] PCT Filed: Mar. 17, 1995

[86] PCT No.: PCT/FI95/00145

§ 371 Date: Nov. 27, 1996

§ 102(e) Date: Nov. 27, 1996

[87] PCT Pub. No.: WO95/25210

PCT Pub. Date: Sep. 21, 1995

[30] Foreign Application Priority Data

Mar. 17, 1994 [FI] Finland ..... 941274

[51] Int. Cl.[6] ..... E04G 21/16

[52] U.S. Cl. ..... 414/11; 52/749.11; 52/749.15; 414/627

[58] Field of Search ..... 414/11, 10, 626, 414/627, 786; 52/749.1, 749.11, 749.14, 749.15, 127.2

[56] References Cited

U.S. PATENT DOCUMENTS

| | | | |
|---|---|---|---|
| 3,842,988 | 10/1974 | Russell | 414/11 |
| 4,591,308 | 5/1986 | Imai | 414/11 |
| 5,018,923 | 5/1991 | Melan et al. | 414/10 |
| 5,181,825 | 1/1993 | Sugitani et al. | 414/11 X |
| 5,224,808 | 7/1993 | Macris | 414/11 |
| 5,516,254 | 5/1996 | Gessler | 414/11 X |

FOREIGN PATENT DOCUMENTS

| | | | |
|---|---|---|---|
| 393004 | 10/1990 | European Pat. Off. | 414/11 |
| 3-176243 | 7/1991 | Japan | 414/11 |

*Primary Examiner*—Janice L. Krizek
*Attorney, Agent, or Firm*—Kubovcik & Kubovcik

[57] ABSTRACT

A method for installing light-weight panel units according to which the light-weight panel units are installed on a wall or roof in such a way that at least two panel units at a time are moved to the vicinity of the installation site. After that, the panel units that have been moved are installed in place one by one. The installation device incorporates an intermediate storage unit, in which can be stored at least two light-weight panel units. The intermediate storage unit can be moved during installation to the installation site in the vicinity of a wall or roof and it incorporates equipment which transfers one light-weight panel unit at a time to the installation site.

9 Claims, 20 Drawing Sheets

METHOD AND DEVICE FOR INSTALLING LIGHT-WEIGHT PANEL UNITS

The object of the present invention is a method for installing light-weight panel units, according to which method a light-weight panel unit is gripped by means of suction cups and moved into place at the installation site.

According to a known installation method, wall panels to be installed on the walls of a building are lifted up onto the wall one by one. In this case the wall panel unit, which is usually a so-called insulated light-weight panel unit, is gripped by means of suction cups and lifted up on the wall, for example, by means of an articulated jib crane mounted on a truck. This type of crane is disclosed, for example, in the German published application DE-3834311 (E04G 21/16).

However, in applying the above method, the light-weight panel units are easily damaged and the work progresses slowly. Another considerable disadvantage is the fact that the wind catches a single panel unit like a sail, which makes precise positioning of the panel difficult. Strong wind may even make working impossible. The panel unit may swing uncontrollably and thus be damaged or even cause damage to its surroundings.

When a jib crane is used, installation of the light-weight panel unit is restricted to the range of the crane, which means that it cannot be used for installing high walls. In addition, the jib crane carrier vehicle will not be able to enter low premises. The equipment combined with a vehicle is also relatively complex and clumsy for many sites. Furthermore, the floors of premises where installations are carried out are often not strong enough to bear the weight of the vehicle.

The object of the present invention is to eliminate the above problems and to provide a new method for installing light-weight panel units. It is characteristic of the method relating to the invention that the light-weight panel units are installed on a wall or roof, in such a way that at least two panel units at a time are moved to the vicinity of the installation site, after which the panel units that have been moved are installed in their place one at a time.

By means of the installation method relating to the invention, the panel units can be lifted onto the wall in a substantially safer manner. When several light-weight panel units are lifted at a time, the wind does not affect the stack of panel units in the same way as a single panel unit. A single panel unit is picked up from the top of the stack in the immediate vicinity of the wall so that the wind will not be able to affect it adversely. Also, at this stage the transfer distances are so short that they do not bring about the same type of problem as when lifting a single panel all the way from the ground. In a stack, the light-weight panel units are also substantially better protected against damage. It is also possible to move the stack in a variety of ways.

The object of the invention also includes a device for installing light-weight panel units, which device (20) comprises at least one suction cup (41), by means of which the light-weight panel unit is moved to the installation site.

It is characteristic of the device relating to the invention that the device comprises an intermediate storage unit in which can be stored at least two light-weight panel units, and which intermediate storage unit can be moved during installation to the installation site in the vicinity of a wall or roof, and that the intermediate storage unit incorporates equipment for moving one light-weight panel unit at a time to the installation site or its vicinity.

The invention is described in detail below by way of examples, with reference to the appended drawings, in which FIG. 1 shows a side view of the installation device according to the invention.

FIGS. 2–4 show the installation device of FIG. 1 at different work stages.

FIG. 5 corresponds to FIG. 4 and shows a second embodiment of the installation device.

Figure 1:
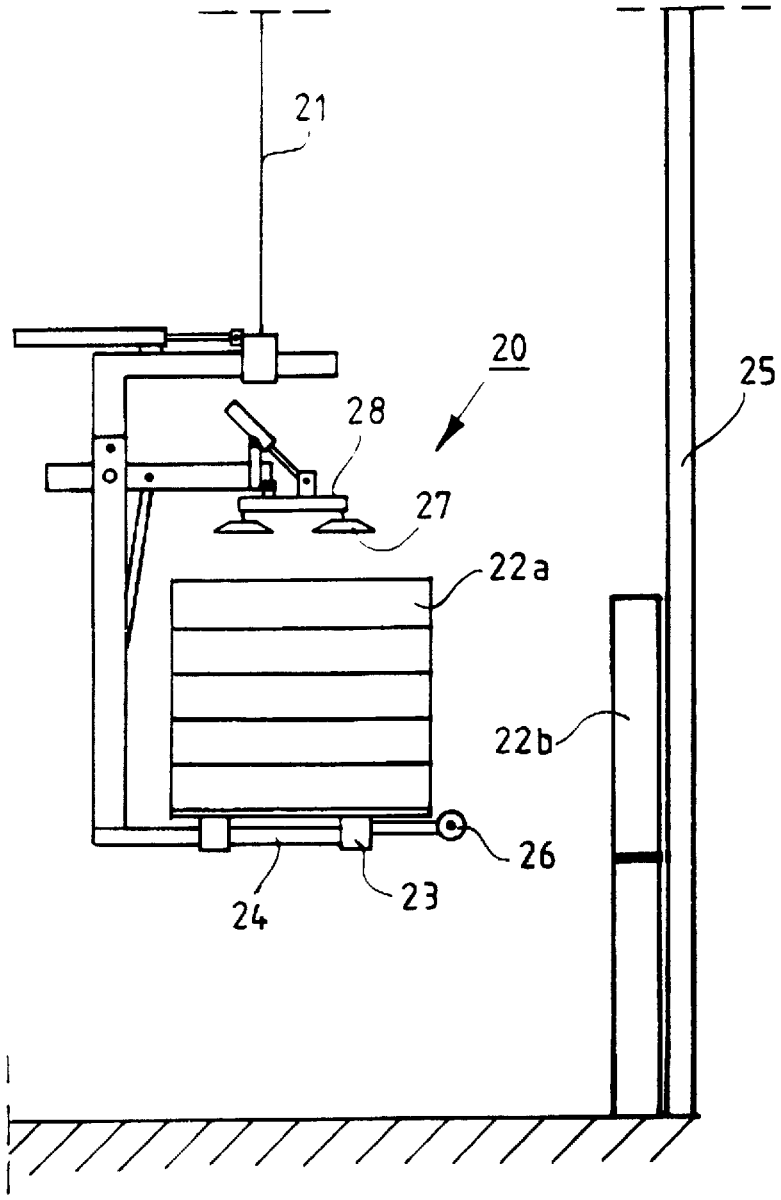
Figure 11:
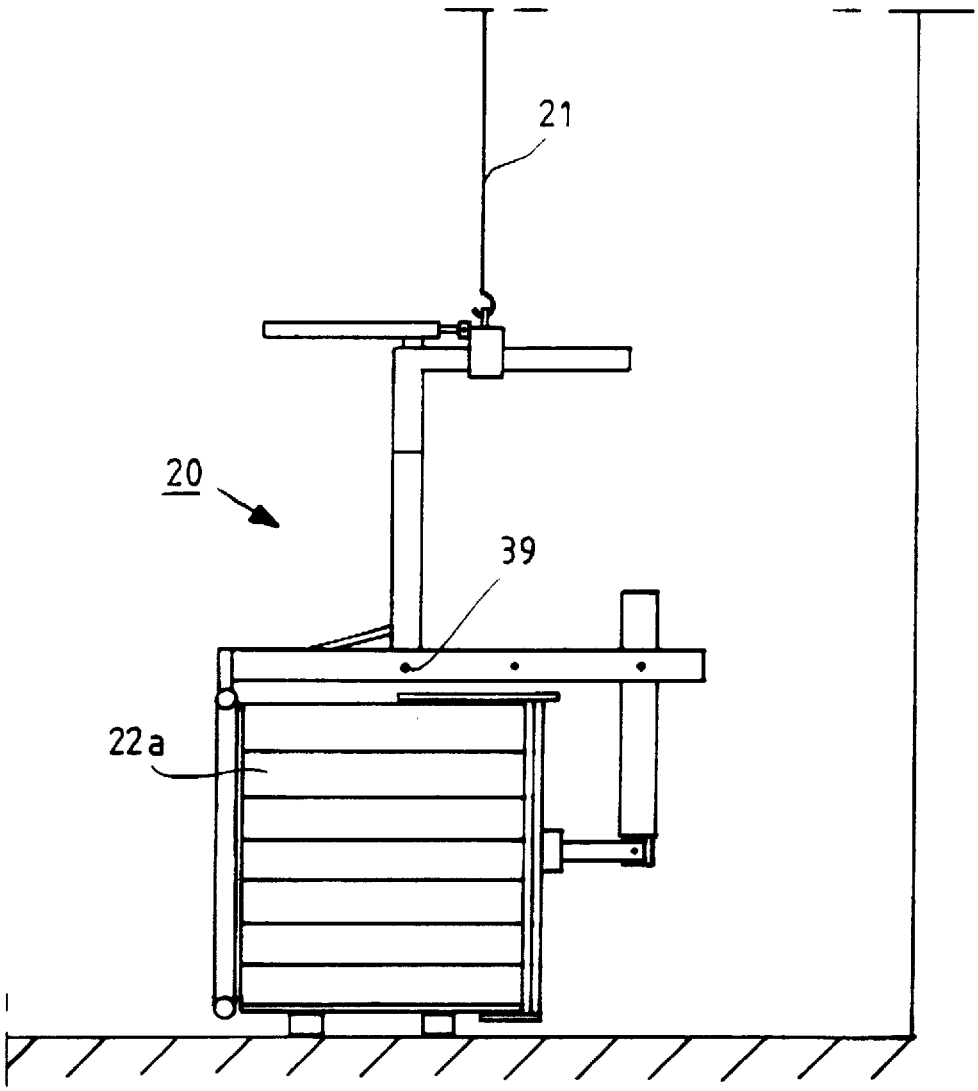

FIG. 11 corresponds to FIG. 1 and shows a third embodiment of the installation device.

Figure 12:
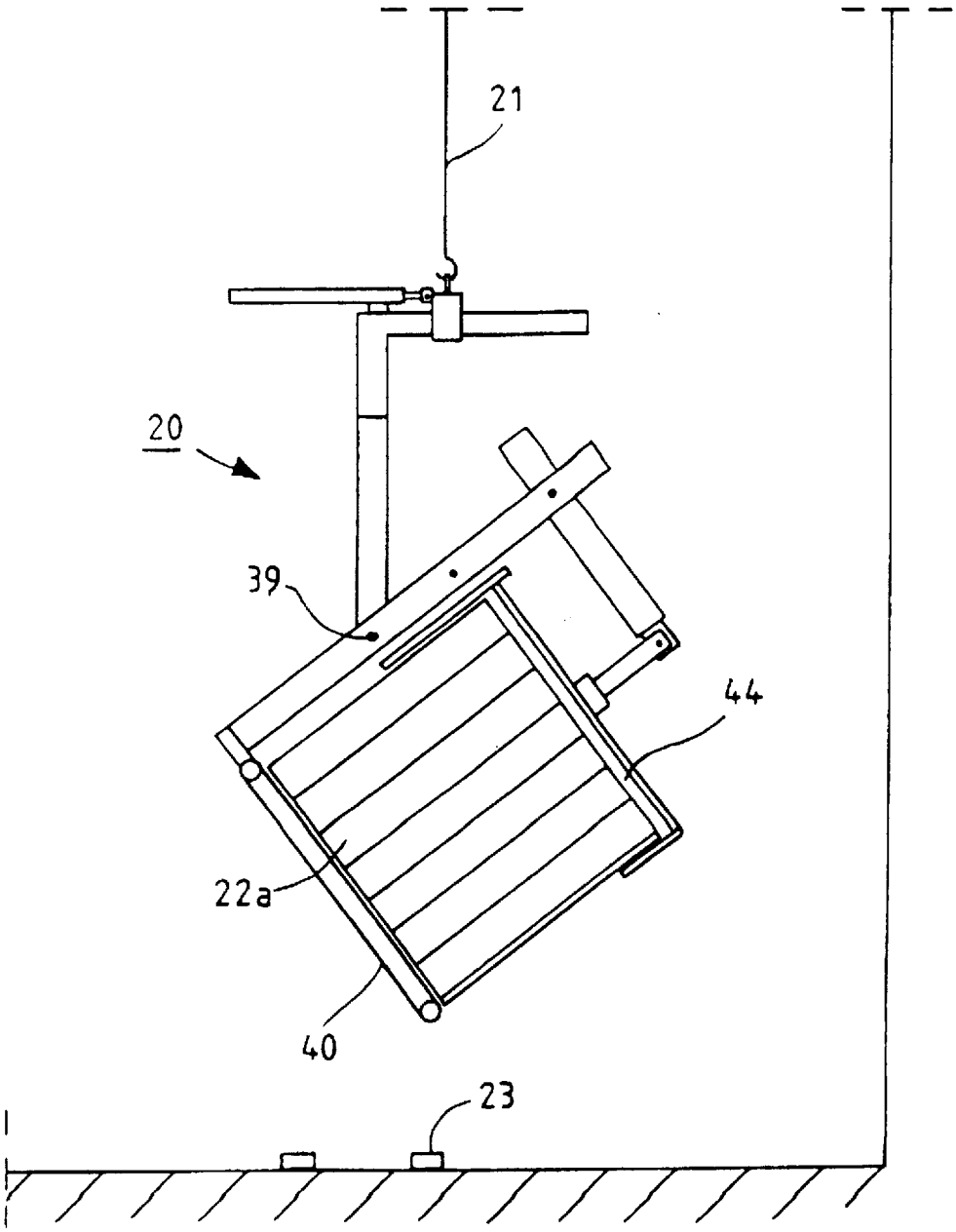
Figure 13:
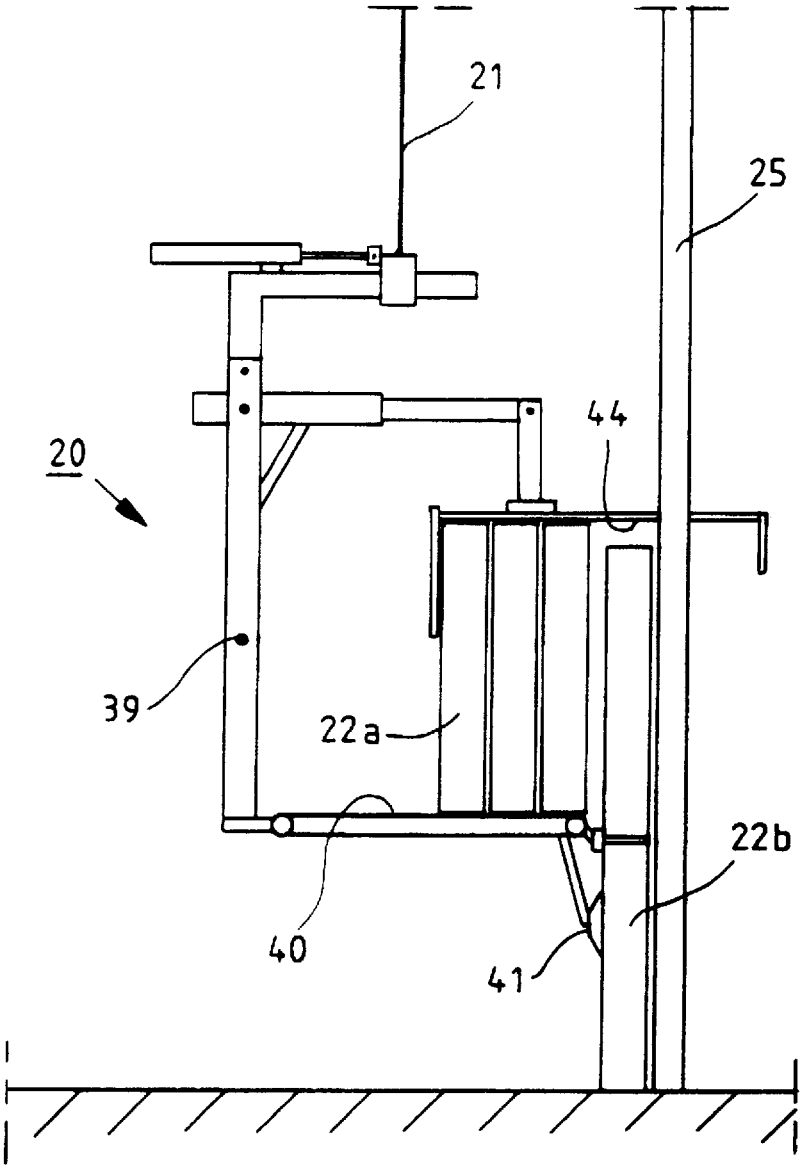

FIGS. 12–13 show the installation device of FIG. 11 at different work stages.

Figure 14:
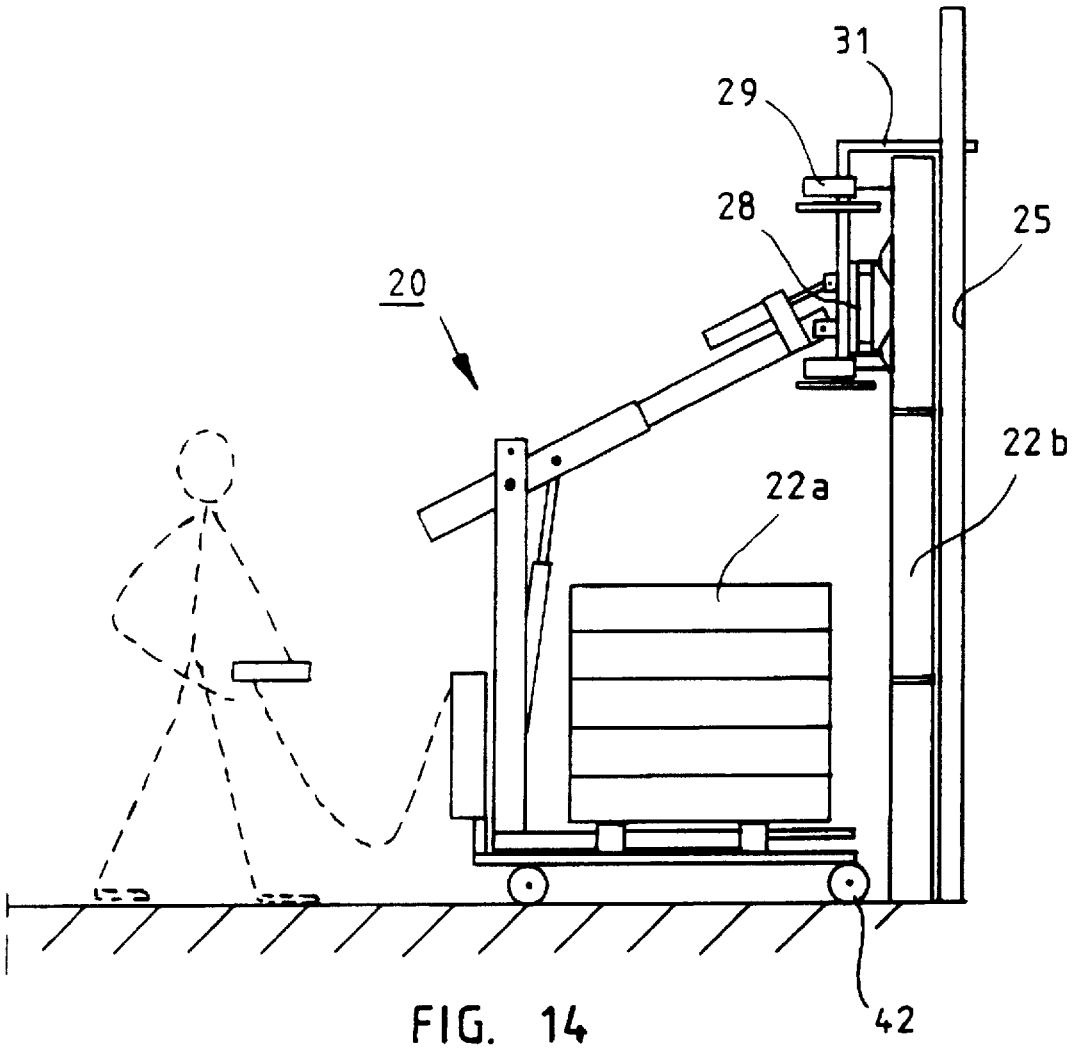

FIG. 14 corresponds to FIG. 1 and shows a fourth embodiment of the installation device.

Figure 15:
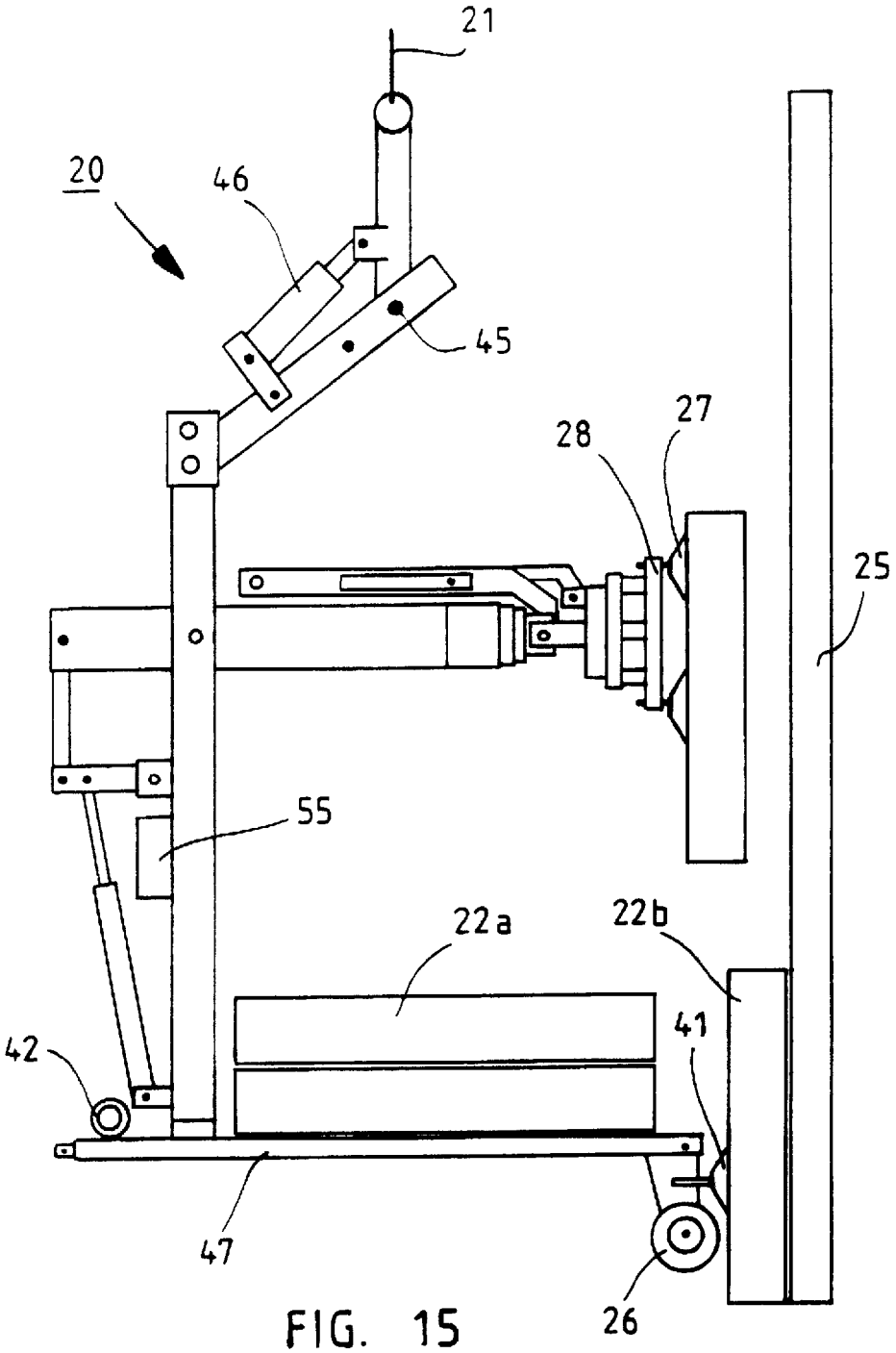

FIG. 15 corresponds to FIG. 1 and shows a fifth embodiment of the installation device.

Figure 16:
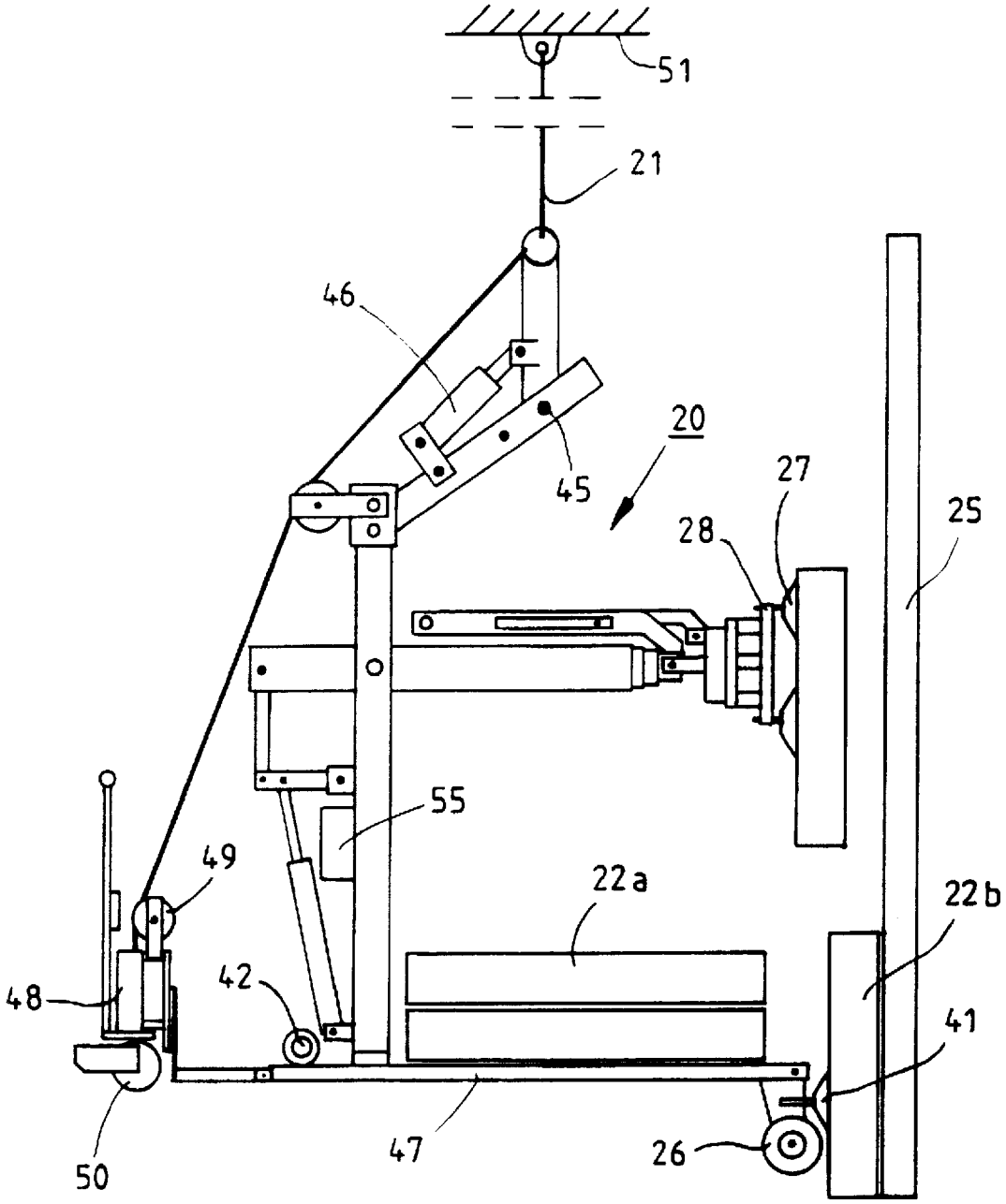

FIG. 16 corresponds to FIG. 1 and shows a sixth embodiment of the installation device.

Figure 9:
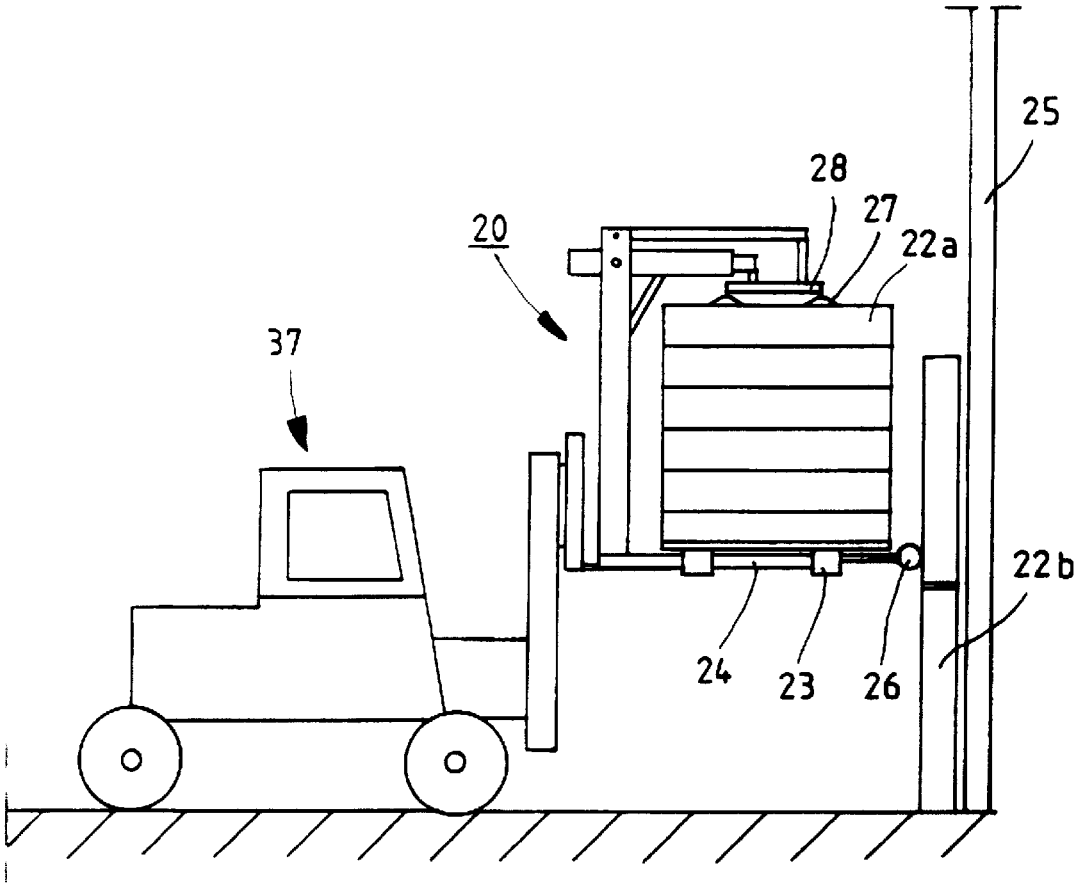
FIG. 9 shows the installation device when connected to a forklift truck.
Figure 17:
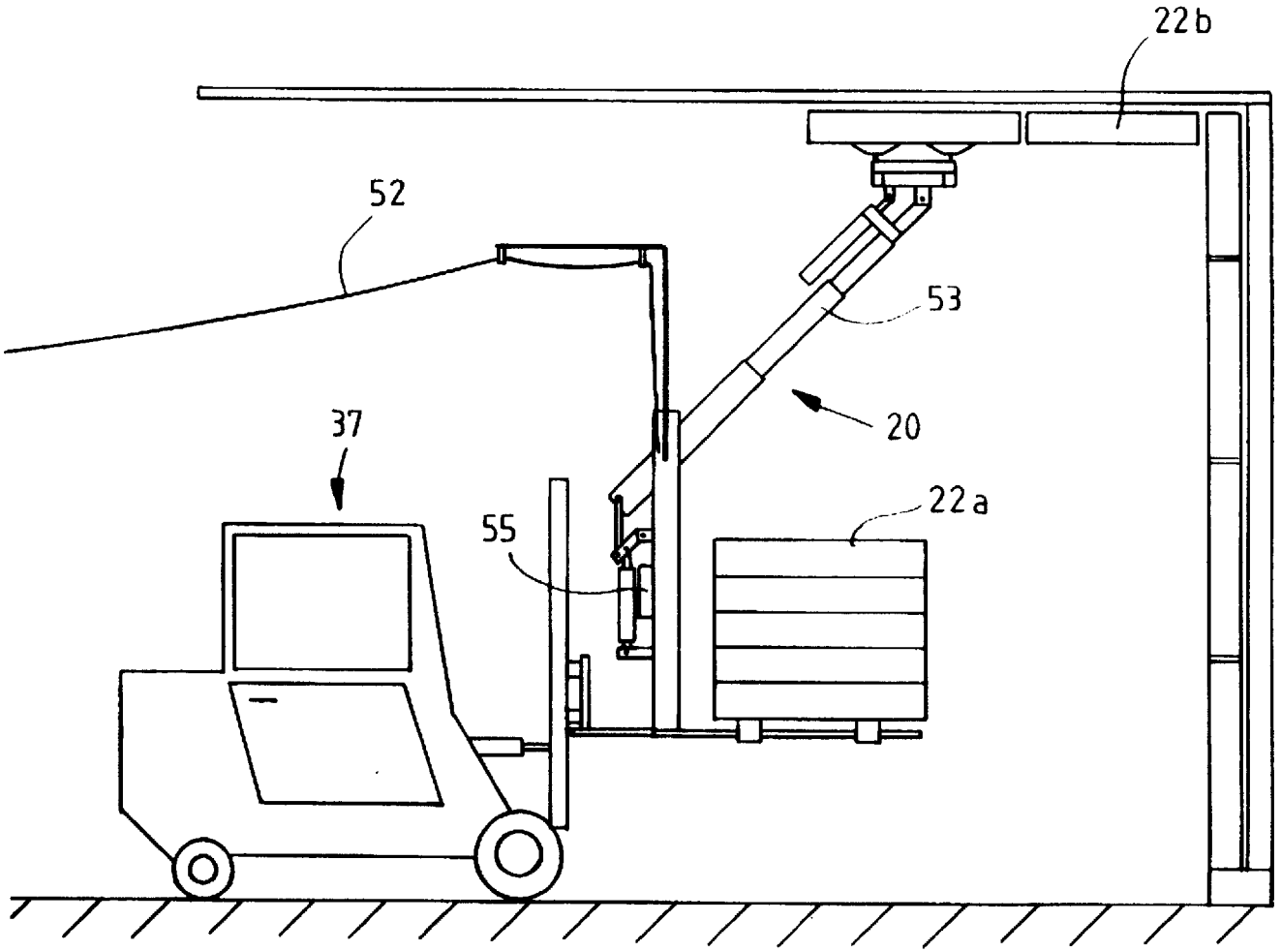

FIG. 17 corresponds to FIG. 9 and shows a seventh embodiment of the installation device.

Figure 18:
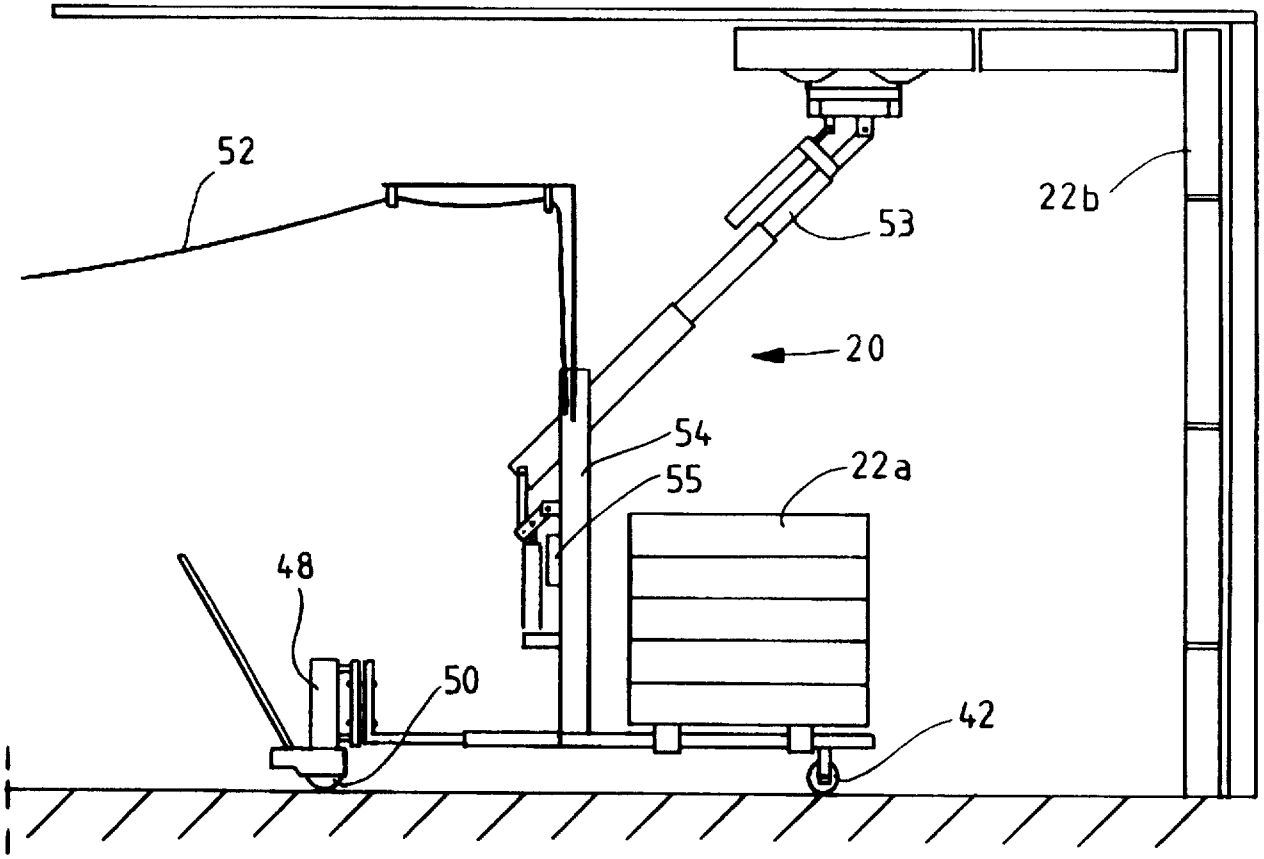

FIG. 18 corresponds to FIG. 14 and shows an eighth embodiment of the installation device.

Figure 19:
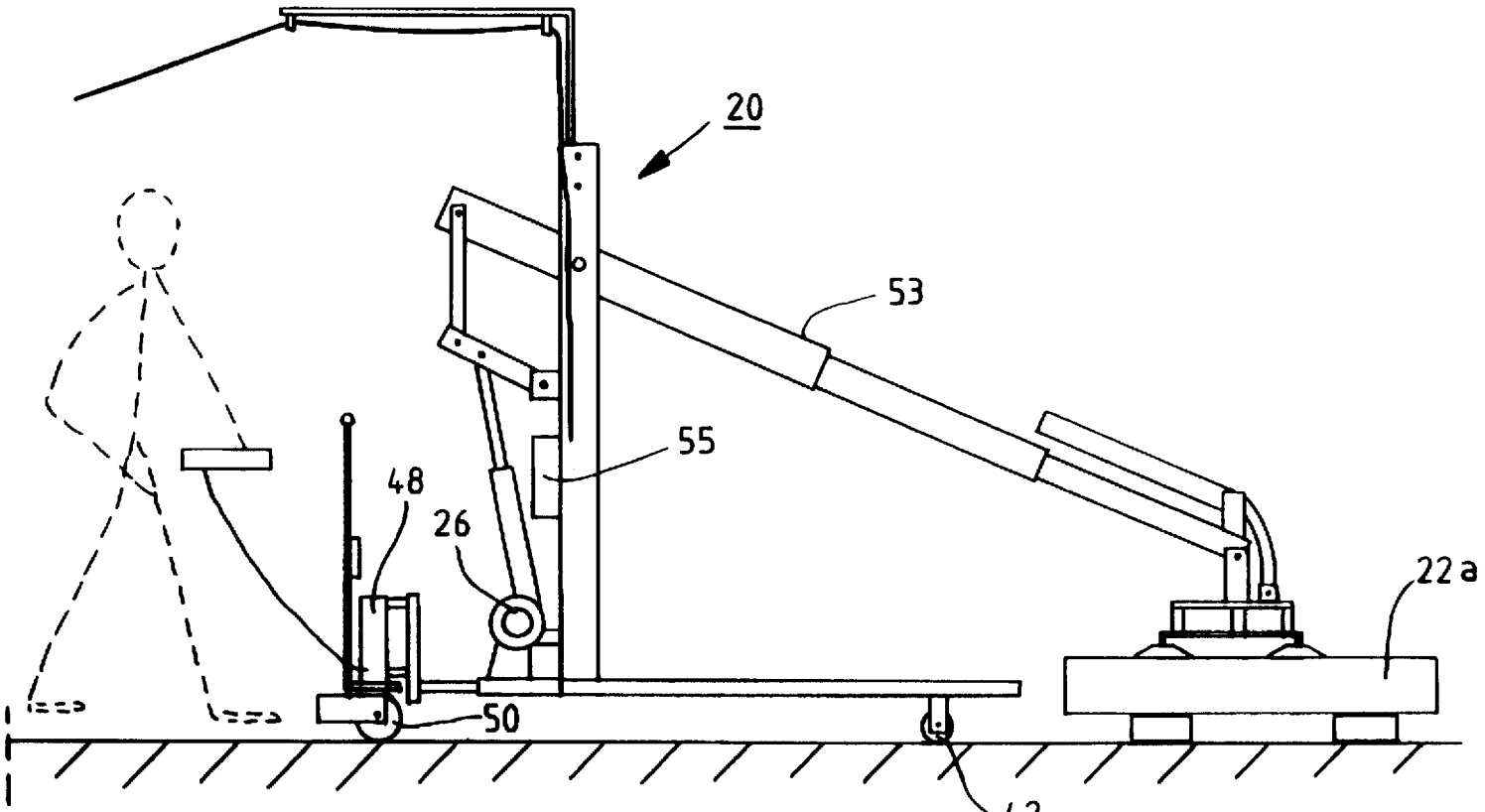

FIG. 19 corresponds to FIG. 18 and shows the installation device during the second work stage.

Figure 20:
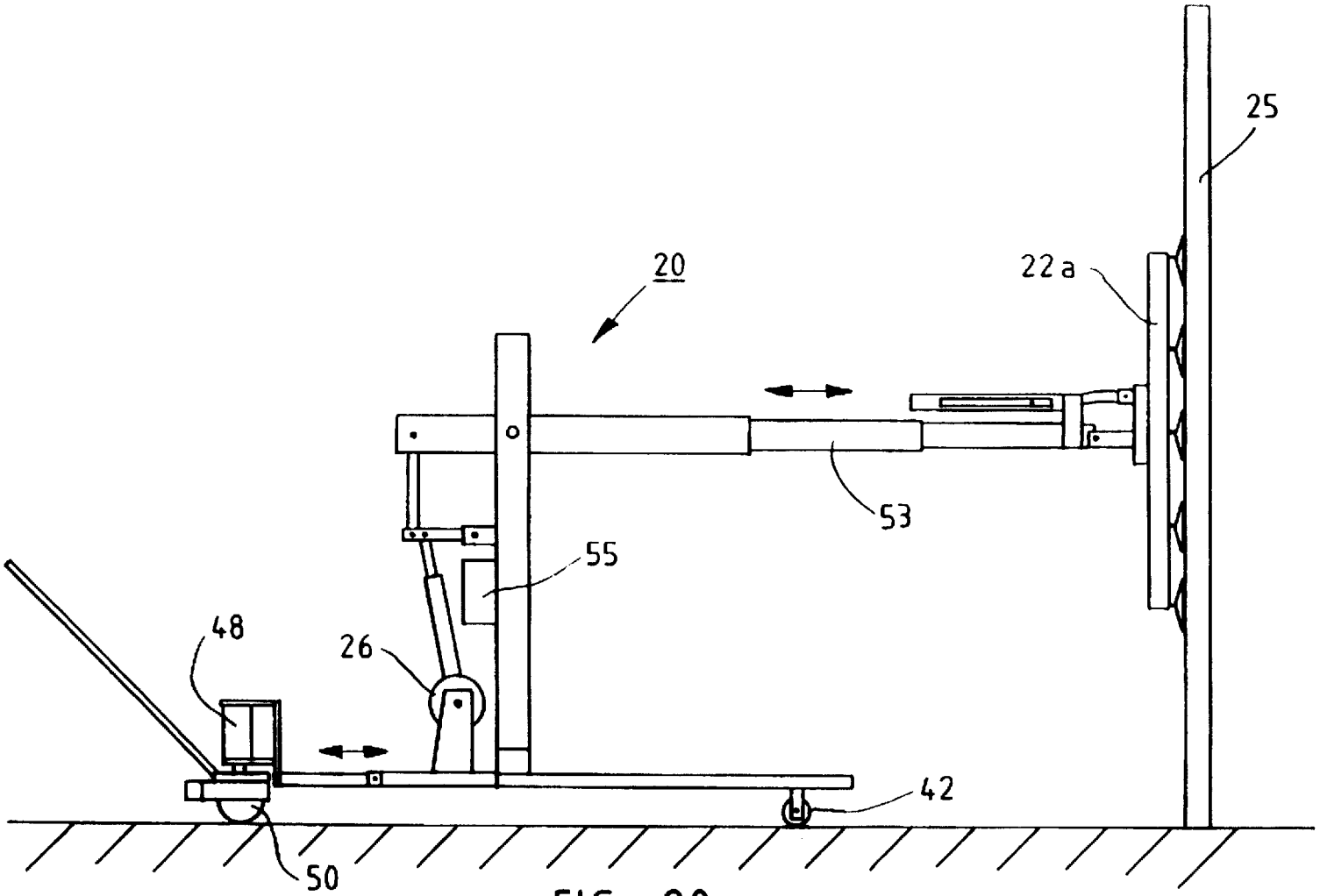

FIG. 20 corresponds to FIG. 18 and shows the installation device during the third work stage.

FIG. 1 shows a side view of the installation device 20 according to the invention for installing light-weight panel units, the device incorporating an intermediate panel unit storage unit. The device 20 is suspended on a wire cable 21 from a crane which is not shown in the figure. In FIG. 1, the light-weight wall or roof panel units 22*a* are stacked on a forklift pallet 23 which is supported by the fork element 24 of the device 20. The panel units 22*a* are installed against the vertical beams 25 of the wall framework shown in FIG. 1 so that the installed panel units 22*b* form an insulated wall structure.

Figure 2:
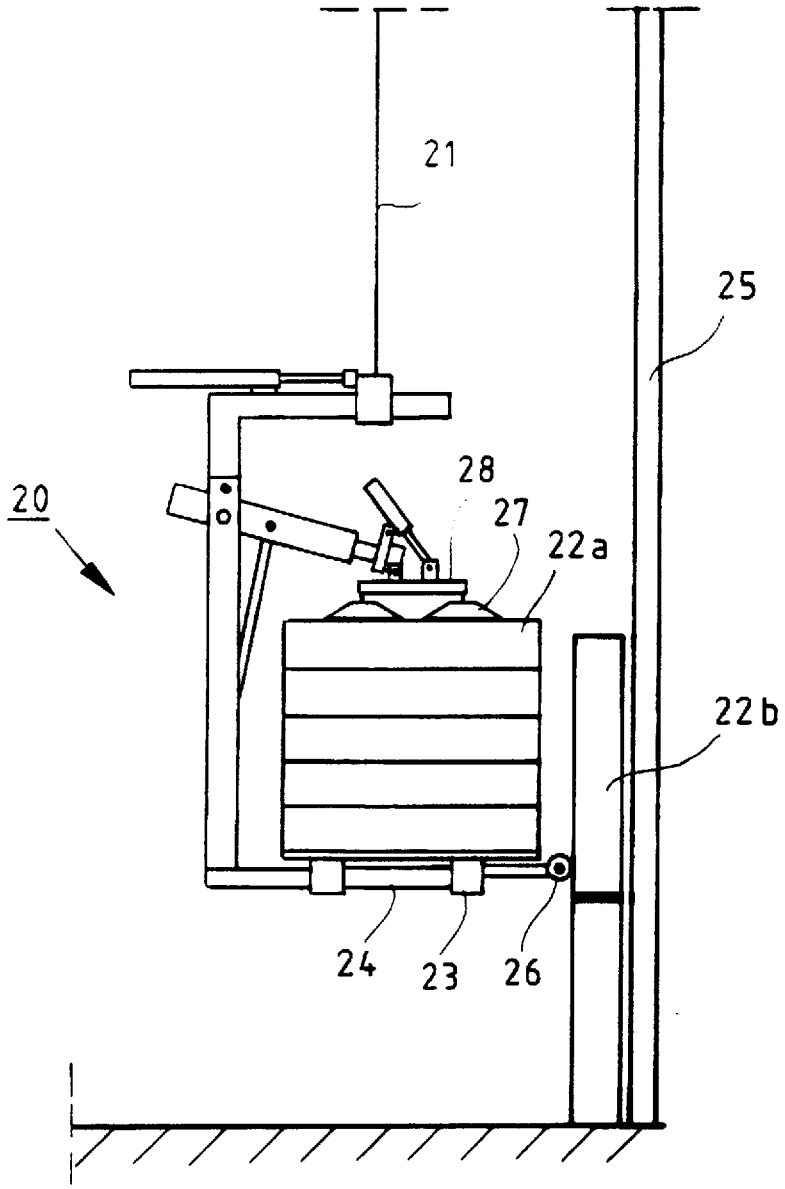

In FIG. 2, the installation device 20 has been brought against the wall panel units 22*b* for the purpose of installing the panel units 22*a*. During the vertical movement, the support roller 26 resting against the wall is pressed against the surface of the panel unit 22*b*. The next panel unit 22*a* is installed in the wall above the previous panel unit 22*b*. To lift the panel unit 22*a*, the installation unit 28 of the installation device 20 provided with suction cups 27 is pressed into contact with the surface of the topmost panel unit 22*a* in the stack.

Figure 3:
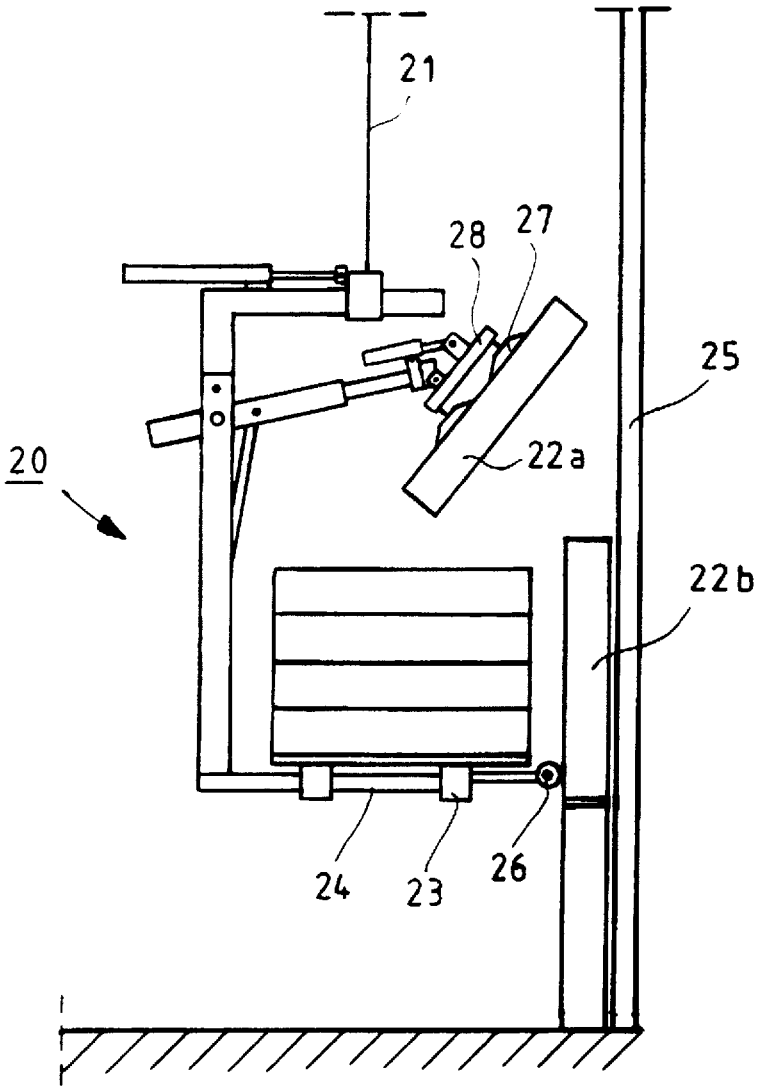

According to FIG. 3, the suction cups 27 of the installation unit 28 of the installation device 20 grip the topmost light-weight panel unit 22*a* and lift it up onto the wall, against the vertical beam 25 of the wall framework, above the preceding, already installed panel unit 22*b*.

Figure 4:
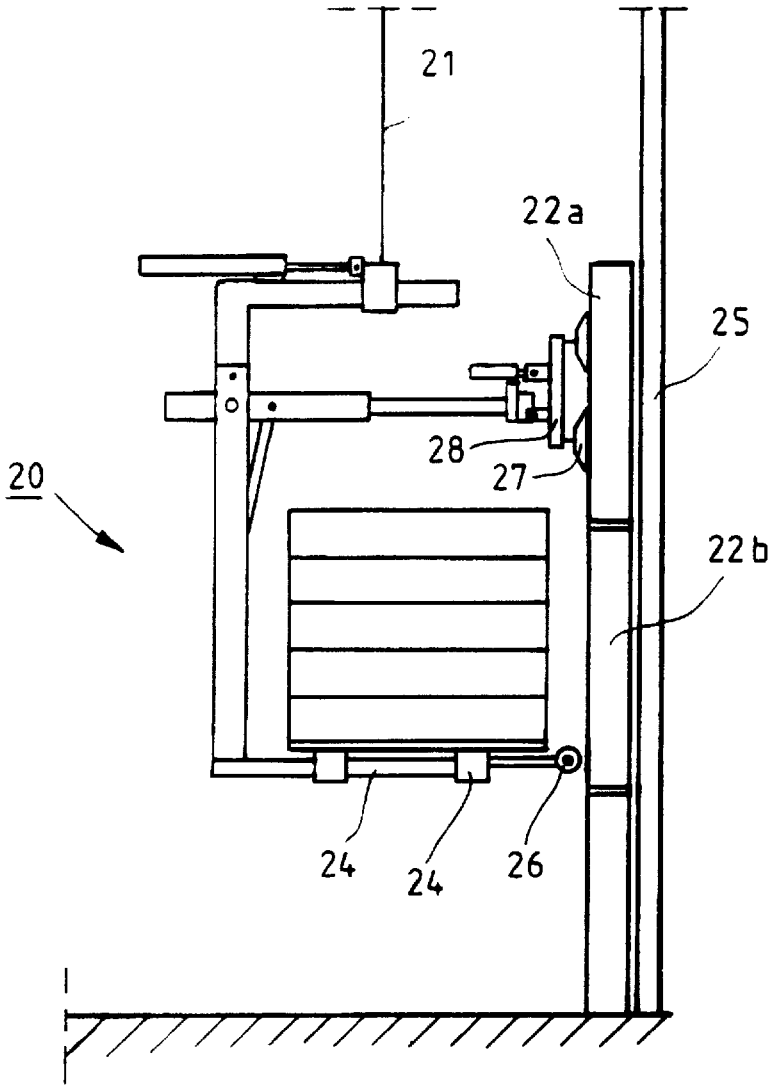

In FIG. 4, the panel unit 22*a* is in place on the wall, after which the panel unit is fastened, for example, by means of screws.

Figure 5:
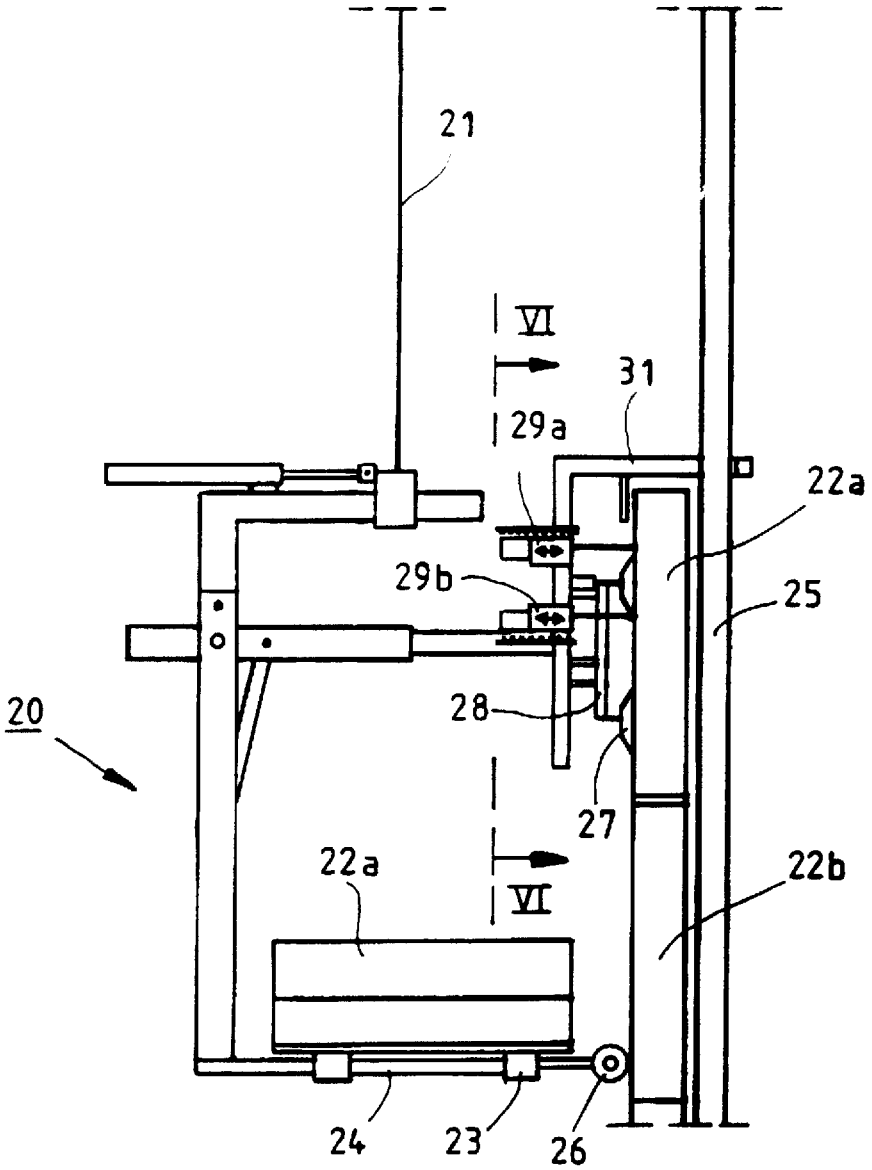

FIG. 5 shows a second embodiment of the installation device 20 according to the invention, in which drilling machines 29*a* and 29*b* are incorporated in the installation unit 28, by means of which machines the light-weight panel unit 22*a* installed in place can be fastened immediately, for example, with self-drilling screws. In this embodiment, the installation unit 28 also comprises support members 31 moving on guide rails, the members being placeable against and behind the vertical beam 25. The support members 31 thus provide the guidance which guides the drilling machine to the correct location for drilling. The support members 31 also take the force generated in pressing the drilling machine 29. Since a greater feed force can thus be applied, the drilling speed can be substantially increased.

Figure 6:
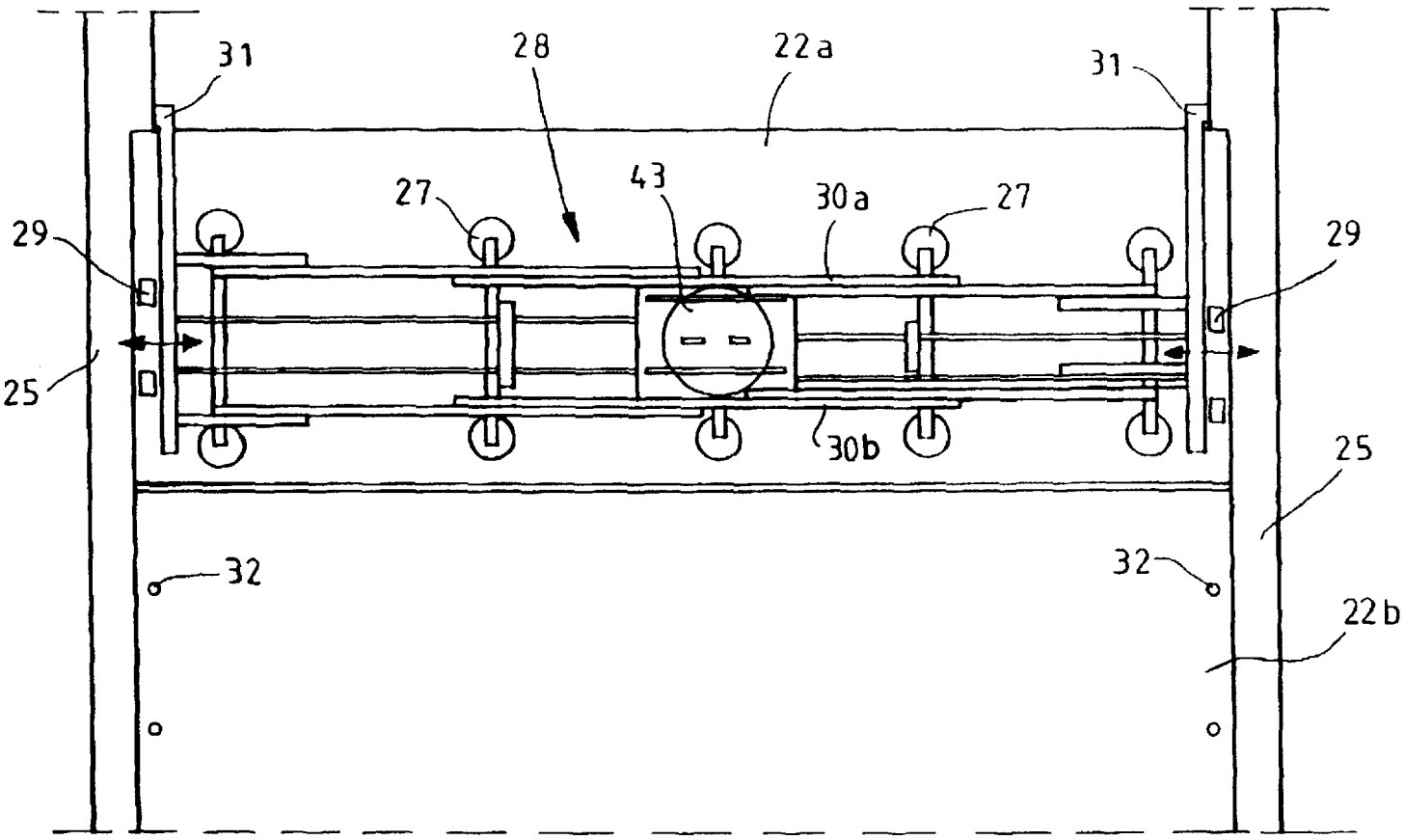
FIG. 6 shows a section along the line VI—VI of FIG. 5.

FIG. 6 shows the installation unit 28 of FIG. 5 from another direction. The suction cups 27 of the installation unit 28 have gripped the light-weight panel unit 22*a* to be installed, which has been lifted in its place against the vertical beams 25, above the preceding wall panel unit 22*b*. In the centre of the installation unit is an alignment joint 43, by means of which the installation unit can be turned to align with the wall being installed. Another essential property of the alignment joint is, however, the fact that it allows free movement of the installation unit and the panel unit fastened to it into alignment with the wall being installed or the beams of the wall framework. The joint is, therefore, capable of revolving around both the horizontal axes and the vertical axis. The essential aspect is that the grooves of the panel unit being installed are guided freely into the corresponding grooves of the already installed panel unit. The tolerances in question are extremely small, which means that the panel unit to be installed must fall into place in exactly the right position. Otherwise tensions will be formed in the tongue-and-groove joint which prevent the formation of a proper joint. Adjustable limiters can also be installed for the movements of the alignment joint 43.

FIG. 6 shows that the installation unit 28 incorporates guide rails 30*a* and 30*b*, by means of which the length of the installation unit can be adjusted in accordance with the width of the panel unit 22*a* to be installed and correspondingly the installation space. On the sides of the installation unit 28 are drilling machines 29, by means of which the self-drilling screws 32 are fastened. The drilling machines 29, like the support members 31, are incorporated in the adjustable side parts of the installation unit 28. When the support members 31 settle against the vertical beams 25, the drilling machines 29 are at the same time positioned at the fastening points for the screws 32.

Figure 7:
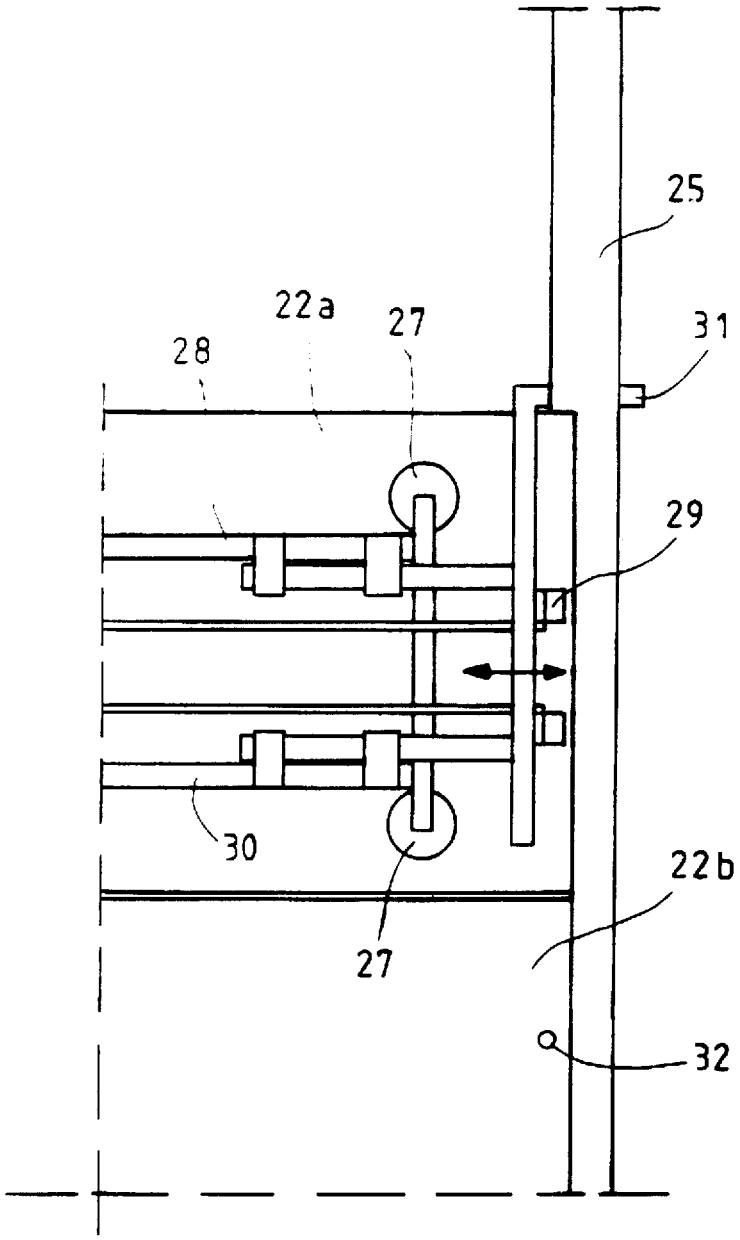
FIG. 7 shows a detail of FIG. 6.

FIG. 7 shows one end of the installation unit 28 in greater detail.

Figure 8:
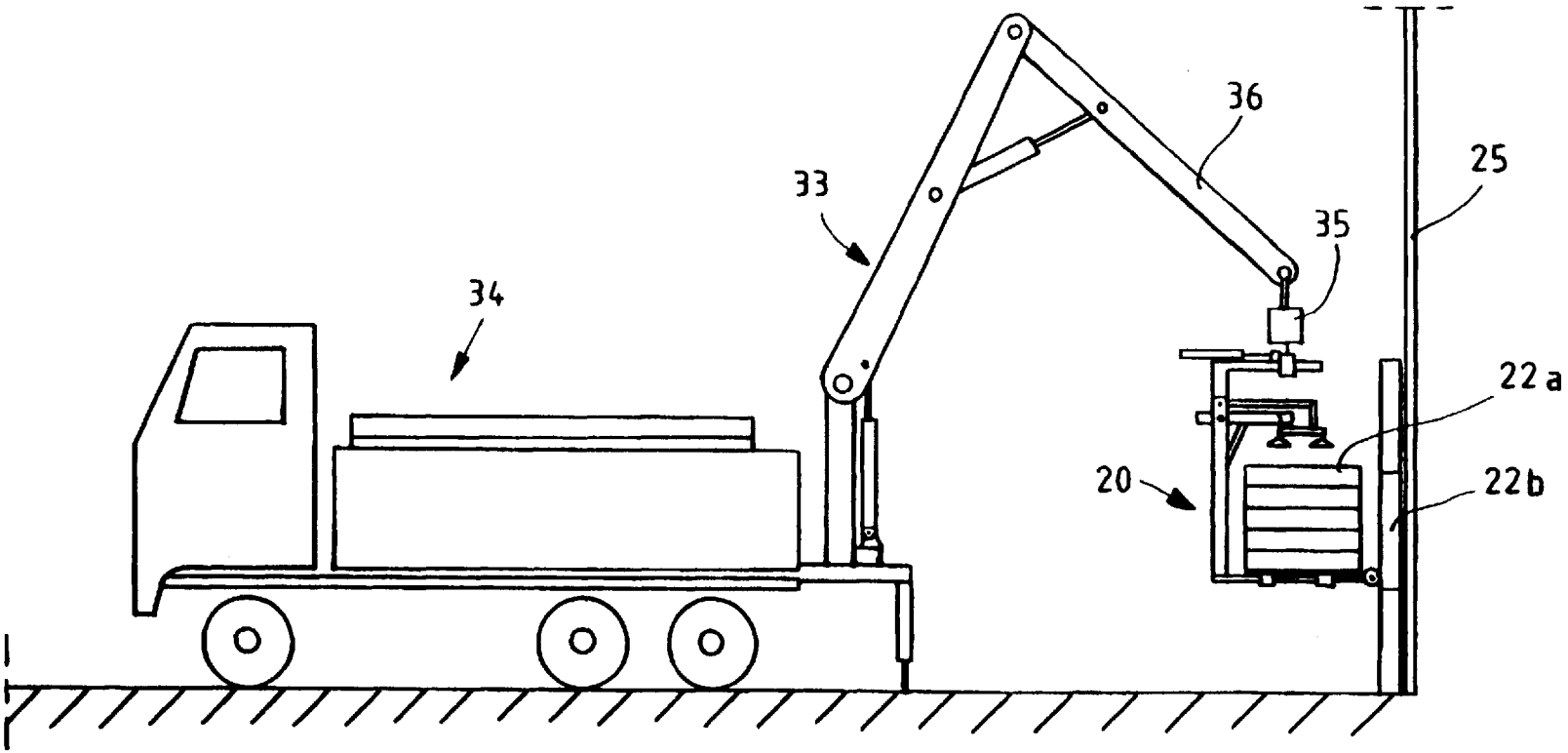
FIG. 8 shows the installation device when connected to a jib crane.

FIG. 8 shows the installation device 20 when connected to a jib crane 33 mounted on a carrier vehicle 34. The device 20 functions in basically the same way as described above. However, the jib crane installation requires a swivelling joint 35 at the end of the jib 36. By means of a device of this type, the light-weight panel unit stack can be moved as such from the truck body directly to the installation site at the wall.

FIG. 9 shows the installation device 20 when incorporated in a forklift truck 37. In this case the installation device 20 is lifted by means of the forklift truck 37's lifter fork which is positioned inside fork element 24.

Figure 10:
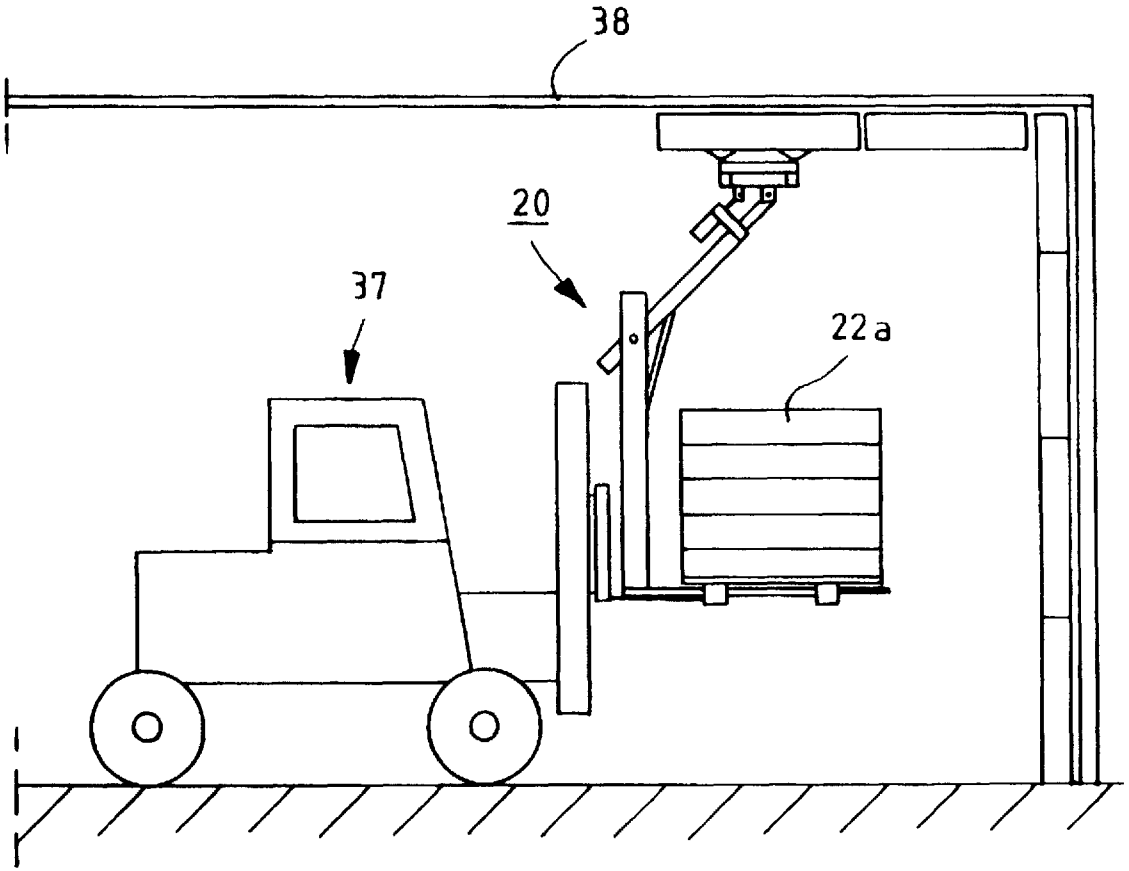
FIG. 10 shows the installation device of FIG. 9 at the second work stage.

FIG. 10 shows the installation of light-weight panel units 22*a* on a ceiling 38 by means of an installation device 20 incorporated in a forklift truck 37. The forklift truck is advantageous in situations where the installation space is so low that a crane is unable to enter it.

FIG. 11 shows a third embodiment of the installation device 20, where the stack of light-weight panel units 22*a* can be turned by means of an inclination joint 39. The turning movement is shown in FIGS. 12 and 13.

In FIG. 13, the panel units 22*a* which have been turned into an upright position are pushed against the vertical beam 25 of the wall framework so that the panel units 22*a* move on a roller mat 40. For the duration of the installation, the device can be anchored to a panel unit 22*b* already installed in the wall by means of an anchoring suction cup 41.

In FIG. 13, the panel units 22*a* move on a roller mat 40 made of soft rubber. The mat can be locked into place for the duration of the turning phase shown in FIG. 12. Above the panel units 22*a* is a corresponding soft rubber layer 44, which keeps the panel units in the intermediate storage unit in place.

FIG. 14 shown a fourth embodiment of the installation device 20 which is equipped with wheels 42. A device 20 of this type is not dependent on a separate crane or the like. It can also be used in extremely low spaces. One person suffices to operate this device 20, and the other above described devices provided with drilling machines.

FIG. 15 shows a fifth embodiment of the installation device 20, where the device has been stabilised by means of a stabilising joint 45 and a stabilising cylinder 46. The device always includes a suction cup 41, a support roller 26 and at least one wheel 42. They can be kept either in the position of use, as the suction cup 41 and support roller are in FIG. 15, or turned away when not in use, as the wheel 42 in FIG. 15. The changeover to different positions is carried out by means of the guide rails inside the lower beam 47, which rails are not shown in FIG. 15. In this embodiment, the support roller 26 is an air-filled rubber wheel which can, if necessary, also be turned so that the installation device can be moved horizontally sideways.

When the installation device shown in FIG. 15 is moved, it can be inclined away from the wall by means of the stabilising cylinder 46. The suction cups 41 will then also detach from the wall. Correspondingly, the suction cups can be made to adhere to the wall by inclining the installation device towards the wall. The suction cups 41 can, however, also be adjusted separately in relation to the support roller 26, that is, be moved towards the wall or away from it.

The installation device shown in FIG. 16 is equipped with a hydraulic unit 55, which incorporates a hydraulic motor 48 that drives both the winch 49 and the transfer wheel 50. This means that the installation device 20 can be suspended on a wire cable 21 from the ceiling or any other separate point of support 51, such as a trestle. Thus the installation device can be made to move vertically on the wall, independently by means of its own equipment, and no separate crane is needed.

The installation device 20 shown in FIG. 16 can also be used to fetch a stack of light-weight panel units 22*a*. In this case, the support roller 26 is moved along its guide rails to the same point as the wheel 42. However, by means of the stabilising cylinder 46, the device can be inclined so that the transfer wheel 50 is on the ground. Thus, by means of the transfer wheel 50, the installation device can be moved along the ground in such a way that its lower beams 47 are inserted under the stack of panel units to be lifted.

FIG. 17 shows the installation device 20 when mounted on a forklift truck 37. In this embodiment, the electricity required by the hydraulic unit 55 is fed via a cable 52. Alternatively, the hydraulic system can also be connected to the forklift truck's hydraulic system, in which case no external power source will be required. The installation device 20 comprises an extendable telescopic jib 53 by means of which the light-weight panel units 22 can be installed in their place by adjusting the length of the jib 53. It is then possible to install several panel units without moving the forklift truck 37.

FIG. 18 shows an installation device 20 comprising a hydraulic motor 48 driven by hydraulic unit 55 and a transfer wheel 50 connected to the motor. The distance of the hydraulic motor 48 from the frame 54 of the installation device can be adjusted. Since the hydraulic motor 48 is relatively heavy, it can be used to stabilise the installation device. By increasing the distance of the hydraulic motor 48, the installation device 20 is prevented from tipping over, even when the telescopic jib 53 is extended. In this case, the light-weight panel units 22 can also be moved in their place by moving the installation device 20 by means of the hydraulic transfer wheel 50. Another way of doing this is to adjust the length of the telescopic jib 53.

In FIG. 18, there are other wheels 42 in addition to the transfer wheel 50, which wheels can also be turned sideways. When the transfer wheel 50 is also turned sideways, the installation device can be moved sideways, for example in a narrow passage.

In FIG. 19, the installation device 20 is used to grip one light-weight panel unit 22*a* at a time. This is also possible, even when the device has the intermediate storage feature. In FIG. 20, the panel unit 22*a* has been lifted against the vertical beam 25 of the wall framework. The installation of the panel unit is carried out either by the transfer movement of the transfer wheel 50 or by lengthening the telescopic jib 53.

FIG. 20 shows that the support roller 26 coming against the wall during the wall installation is turned away as it is not in use, and the wheel 42 is in use. In FIGS. 15 and 16, the situation was the opposite. Correspondingly, in the forklift truck installation shown in FIG. 17, the hydraulic motor 48 with support structures, as shown in FIGS. 15 and 16, was removed. The hydraulic motor 48 is intended to be mounted in such a way that it can be installed in place by means of joining elements corresponding to the spikes of a forklift truck.

In FIG. 20, the installation device 20 can be moved by operating the hydraulic motor 48. The distance between the hydraulic motor and the frame 54 is also adjustable. The installation of the panel unit 22*a* can be carried out by moving the entire device or by adjusting the length of the jib 53.

It is obvious to a person skilled in the art that the various embodiments of the invention may vary within the scope of the claims presented below.

I claim:

1. A device for installing light-weight panel units which device (20) comprises at least one suction means (27) for gripping a light-weight panel unit;

means (28) to which said at least one suction means (27) is attached for moving one light-weight panel unit at a time into place at an installation site;

an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site; and a fastening means (29) for fastening a light-weight panel unit to a wall or roof before transferring the next panel unit from the intermediate storage unit to the installation site.

2. A device for installing light-weight panel units which device (20) comprises at least one suction means (27) for gripping a light-weight panel unit;

means (28) to which said at least one suction means (27) is attached for moving one light-weight panel unit at a time into place at an installation site; and an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site;

wherein the device is suspended from a wire cable (21) and an external point of support (51), and the device includes a lifting device (49).

3. A device for installing light-weight panel units which device (20) comprises at least one suction means (27) for gripping a light-weight panel unit;

means (28) to which said at least one suction means (27) is attached for moving one light-weight panel unit at a time into place at an installation site; and an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site;

wherein the device is suspended from a wire cable (21) of a crane.

4. A device for installing light-weight panel units which device (20) comprises at least one suction means (27) for gripping a light-weight panel unit;

means (28) to which said at least one suction means (27) is attached for moving one light-weight panel unit at a time into place at an installation site; and an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site;

wherein the device is connected to the jib (36) of an articulated jib crane (33).

5. A device for installing light-weight panel units which device (20) comprises at least one suction means (27) for gripping a light-weight panel unit;

means (28) to which said at least one suction means (27) is attached for moving one light-weight panel unit at a time into place at an installation site; and an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site;

wherein the device is connected to the lifter fork (24) of a forklift truck (37).

6. A device for installing light-weight panel units which device (20) comprises at least one suction means (27) for gripping a light-weight panel unit;

means (28) to which said at least one suction means (27) is attached for moving one light-weight panel unit at a time into place at an installation site;

an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site; and a support roller (26) for resting against a wall or a suction cup (41) for adhering to a wall.

7. A device for installing light-weight panel units which device (20) comprises at least one suction means (27) for gripping a light-weight panel unit;

means (28) to which said at least one suction means (27) is attached for moving one light-weight panel unit at a time into place at an installation site;

an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site; and a power unit (55) for moving the device on wheels (42, 50) along the ground;

wherein wheels (42) can be moved into and away from a position for use.

8. A device for installing light-weight panel units which device (20) comprises at least one suction means (27) for gripping a light-weight panel unit;

means (28) to which said at least one suction means (27) is attached for moving one light-weight panel unit at a time into place at an installation site;

an intermediate storage unit (20) in which can be stored at least two light-weight panel units (22*a*), and which intermediate storage unit can be moved during installation to the installation site in the vicinity of a wall or roof, wherein said intermediate storage unit incorporates said means (28) for moving one light-weight panel unit at a time and for positioning said panel unit into place at the installation site; and a detachable hydraulic motor (48) mounted on said installation device, to the same fastening members as the spikes of a fork of a forklift truck.

9. A device as claimed in any one of claims 1, 2–5 and 8, wherein said means (28) is adapted to pick up one light-weight panel unit (22*a*) from the top of a stack of panel units in the intermediate storage unit, turn said panel unit into alignment with the plane of the wall or roof, and position said panel unit into place at the installation site.

* * * * *